US011452349B2

(12) United States Patent
Ruiz et al.

(10) Patent No.: US 11,452,349 B2
(45) **Date of Patent: *Sep. 27, 2022**

(54) MULTI-COMPONENT EYELASH CASE

(71) Applicant: Baddie B Lashes, LLC, Yorba Linda, CA (US)

(72) Inventors: Jennifer Ruiz, Yorba Linda, CA (US); Emmanuel Santana, Yorba Linda, CA (US)

(73) Assignee: Baddie B Lashes, LLC, Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/817,542

(22) Filed: Mar. 12, 2020

(65) Prior Publication Data

US 2020/0359759 A1 Nov. 19, 2020

Related U.S. Application Data

(63) Continuation of application No. 16/412,352, filed on May 14, 2019, now Pat. No. 10,588,389.

(51) Int. Cl.

| | |
|---|---|
| ***A45C 11/00*** | (2006.01) |
| ***A45C 13/10*** | (2006.01) |
| ***A41G 5/02*** | (2006.01) |

(52) U.S. Cl.

CPC ..... *A45C 11/008* (2013.01); *A41G 5/02* (2013.01); *A45C 13/1069* (2013.01); *A45C 2200/10* (2013.01)

(58) Field of Classification Search

CPC ..... A45C 11/008; A45C 13/1069; A45C 2200/10; A45C 11/00; A41G 5/02

USPC ..... 206/581, 823

See application file for complete search history.

(56) References Cited

U.S. PATENT DOCUMENTS

| | | | |
|---|---|---|---|
| 1,667,564 | A | 4/1928 | Pearson |
| 2,534,100 | A | 12/1950 | Baumgartner |
| 3,315,689 | A | 4/1967 | Melik |
| 3,333,593 | A | 8/1967 | McGivern |
| 3,491,775 | A | 1/1970 | Aylott |
| 4,018,336 | A | 4/1977 | Aylott |
| 5,163,457 | A | 11/1992 | Lombardi, Jr. |
| 6,086,176 | A | 7/2000 | Aoyama |
| 7,950,754 | B2 | 5/2011 | Brown et al. |
| 8,636,016 | B1 | 1/2014 | Lee |
| 8,701,685 | B2 | 4/2014 | Chipman |
| 8,881,741 | B1 | 11/2014 | Mattson et al. |
| 9,185,981 | B1 | 11/2015 | Kane et al. |

(Continued)

OTHER PUBLICATIONS

U.S. Appl. No. 16/412,352, filed May 14, 2019, U.S. Pat. No. 10,588,389.

(Continued)

*Primary Examiner* — Jacob K Ackun

(74) *Attorney, Agent, or Firm* — UltimatEdge IP Law Group, P.C.; Dean G. Stathakis

(57) ABSTRACT

In one aspect, the present specification discloses a multi-component eyelash case for the safe keeping and storage of false eyelashes and/or eyelash extensions. In one embodiment, the eyelash case includes a sleeve, a drawer having eyelash mounts therein and a biasing mechanism whereby the mechanism provides biasing of the drawer into a drawer compartment when elements of the biasing mechanism are brought to within a biasing proximity of each other, thus securing the drawer and preventing its unintended opening.

20 Claims, 5 Drawing Sheets

(56) References Cited

U.S. PATENT DOCUMENTS

| | | | |
|---|---|---|---|
| 9,194,847 | B2 | 11/2015 | Burnett et al. |
| 9,554,648 | B2 | 1/2017 | Hernandez Zaragoza |
| D778,650 | S | 2/2017 | Jackson |
| D829,381 | S | 9/2018 | Kim |
| D839,595 | S | 2/2019 | Asher |
| 10,362,823 | B1 | 7/2019 | Hill et al. |
| 10,588,389 | B1 | 3/2020 | Ruiz et al. |
| 2009/0044827 | A1 | 2/2009 | Zilber et al. |
| 2009/0071867 | A1 | 3/2009 | Au |
| 2009/0126758 | A1 | 5/2009 | Chen |
| 2009/0272659 | A1 | 11/2009 | Kaiser et al. |
| 2013/0160787 | A1 | 6/2013 | Chae |
| 2014/0110304 | A1 | 4/2014 | Wu et al. |
| 2014/0238434 | A1 | 8/2014 | Blanch |
| 2014/0299151 | A1 | 10/2014 | Stroud |
| 2015/0201692 | A1 | 7/2015 | Hansen et al. |
| 2015/0351476 | A1 | 12/2015 | Lin |
| 2016/0037848 | A1 | 2/2016 | Lee |
| 2016/0206092 | A1 | 7/2016 | Hernandez Zaragoza |
| 2017/0265623 | A1 | 9/2017 | Kamboj |

OTHER PUBLICATIONS

WIPO, PCT Form ISA210, International Search Report for International Application Serial No. PCT/US2020/032818, pp. 8 (dated Aug. 10, 2020).

WIPO, PCT Form ISA237, Written Opinion for International Application Serial No. PCT/US2020/032818, pp. 5 (dated Aug. 10, 2020).

YouTube video, Blac Chyna Lashed Bar Eyelashes at www.youtube.com/watch?v=9yBZYqbWoXA (Jan. 21, 2014).

YouTube video, Eye on Glam: Lashes with Blac Chyna at www.youtube.com/watch?v=RIR2aKuDRDc (Mar. 25, 2014).

YouTube video, Diy Eyelash Packaging Box Manufacturer Wholesale Custom Mink Eyelash Vendors Lash Packaging Ideas at www.youtube.com/watch?v=MMBnTMvc-_I (Mar. 23, 2019).

Chikazumi, Physics of Ferromagnetism, pp. 668 (2 ed., Oxford University Press, 2005).

MULTI-COMPONENT EYELASH CASE

CROSS-REFERENCE TO RELATED APPLICATION

This application is a continuation that claims the benefit of priority and the filing date pursuant to 35 U.S.C. § 120 to U.S. patent application Ser. No. 16/412,352, filed May 14, 2019, an utility application related to U.S. Design Patent Application Ser. No. 29/691,209, filed on May 14, 2019, the contents of each of which are herein incorporated by reference in their entirety.

FIELD

The present invention relates in general to beauty products and more particularly, to an eyelash case for false eyelashes and/or eyelash extensions.

BACKGROUND

One part of the human face to which much attention is lavished is the eyes. Throughout human history, the eyes have been the focus of much attention and decoration. The eyes are considered by many to be one of the most important symbolic sensory organs. The eyes can represent clairvoyance, omniscience, and/or a gateway into the soul. Other qualities that eyes are commonly associated with include intelligence, vigilance, moral conscience, and truth. As part of some customs, looking someone in the eye is considered a custom/indication of honesty.

A particularly important part of the eye area are the eyelashes. A lash is one of the hairs that grows at the edge of the eyelid. Eyelashes typically grow in three layers on the edge of the eyelid and comprise natural eyelashes. Eyelashes protect the eye from debris, dust and small particles and perform some of the same functions as whiskers do on a cat or a mouse in the sense that they are sensitive to being touched, thus providing a warning that an object (such as an insect, for example) is near the eye, which then typically causes the eyelid to close reflexively to protect the eye.

In this regard, there are several approaches that are utilized to enhance the appearance of the eye area, particularly the eyelashes of the eye area. In one aspect, mascara can be utilized to darken and thicken eyelashes. Mascara is typically comprised of ingredients such as pigments, for example, carbon black, iron oxide or other pigments effective to darken lashes, polymers that coat the lashes, preservatives, and thickening waxes or oils such as lanolin, mineral oil, paraffin, petrolatum, castor oil, carnauba wax, and candelilla. Mascara is typically applied to natural eyelashes utilizing a brush with bristles, the mascara being applied in a single coating or in multiple coatings.

Another method by which the appearance of the eye area can be enhanced is by the application of false eyelashes, eyelash extensions or a combination thereof. False eyelashes and eyelash extensions are not the same, although both are typically comprised of false lashes, that is, lashes that are non-native (i.e. not naturally growing out of a person's eyelid) and can be made of materials such as horse hair, mink, plastic, synthetic polymers or other fibers.

False eyelashes are temporary and are applied to the margin of an eyelid with temporary glue. They are temporary in that they are relatively easily removable, and are not designed to be worn when showering, sleeping or swimming. False eyelashes can be provided as clusters, and most commonly, in the form of false lashes attached to a false eyelash base. An false eyelash is comprised of a plurality of lashes that are attached to and emanate from a base of material. In use, the false eyelash base with its plurality of lashes are temporarily secured to an eyelid utilizing an adhesive, such as a glue, typically a glue that allows one to easily apply and remove the false eyelash base from one's eyelid.

Eyelash extensions, distinguished from false eyelashes, are often considered to be "semi-permanent" in that they can be worn for a longer period of time. Eyelash extensions can be individual lashes/hairs that are applied with an adhesive, for example, cyanoacrylate, to individual native/natural lashes. Eyelash extensions can be applied to a person's natural lashes and/or can be applied to false lashes that are emanating from a false eyelash base, as described above. Various types of cyanoacrylates including ethyl, methyl, butyl, and octyl, are available and are suitable for bonding to different surfaces. Some lash adhesives are made from methyl-2-cyanoacrylate, which is designed to bond a smooth surface (the eyelash extension) and to a porous surface (the native/natural eyelash). It is designed to be used around the eyes and on the native/natural lashes, but not on a person's skin.

Generally, a single eyelash extension is applied to each native/natural lash. When applied properly, neither the eyelash extension nor the glue should touch the eyelid itself. As mentioned above, eyelash extensions are considered to be "semi-permanent" in that they are designed to last until the native/natural lashes fall out of their own accord, which is usually around 3 to 4 weeks. After those 3 to 4 weeks, new lash growth will need to be attended to, making lash extensions a regular monthly service if one wishes to maintain a full look.

False eyelashes and eyelash extensions are often quite delicate and are typically provided in cases in order to protect them when not being worn. Such cases should provide secure, safe and easy access for a user of the false eyelashes or eyelash extensions. Accordingly, there is a need for an eyelash case and associated methods for safe and secure storing, displaying, access and safe keeping of false eyelashes and/or eyelash extensions.

SUMMARY

In one aspect, the present disclosure describes an eyelash case comprising a sleeve and a drawer slidably fitted within the sleeve. In one aspect of the invention, the case comprises a biasing mechanism that biases the drawer in the sleeve.

The sleeve may have a first end and a second end, where the first end and the second end are opposing and spaced apart from one another, a sleeve top wall and a sleeve bottom wall, the sleeve top wall and sleeve bottom wall opposing and spaced apart from one another. In an embodiment, a first sleeve side wall and a second sleeve side wall are further provided, where the first sleeve side wall and the second sleeve side wall are opposed and spaced apart from one another and the first end, second end, sleeve top wall, sleeve bottom wall, first sleeve side wall and second sleeve side wall are provided in an arrangement to provide a drawer compartment into which the drawer slides and fits.

The drawer can have a first and second drawer ends opposed and spaced apart from each other, as well as a first and second drawer sides opposed and spaced apart from each other and substantially perpendicular to the first and second drawer ends. The drawer can include a drawer bottom and the drawer ends, drawer sides and drawer bottom bound and provide an internal drawer space. In a particular aspect, at least one eyelash mount is provided within the internal drawer space.

In another aspect, the biasing mechanism includes at least two components, a sleeve biasing element and a drawer biasing element, the sleeve biasing element provided at the sleeve and in proximity to the drawer compartment, and the drawer biasing element provided at the drawer. The drawer biasing element, as one example, is in substantial alignment with the sleeve biasing element and arranged such that upon insertion of the drawer into the drawer compartment of the sleeve, the sleeve biasing element and the drawer biasing element cause the drawer to bias into the drawer compartment. In one aspect, the sleeve is biased into the drawer when the drawer biasing element and the sleeve biasing element are brought into a proximity of each other. In some embodiments, the case is configured such that the sleeve is biased into the drawer only when the drawer biasing element and the sleeve biasing element are in a proximity to one another, but not when outside such proximity.

In still other aspects, the biasing mechanism can be a magnetic biasing mechanism. In a particular embodiment, one of the sleeve biasing element and drawer biasing element is a magnet, or in another embodiment, the sleeve biasing element and drawer biasing element are both magnets, one biasing element attracting the other or each other. In still yet another aspect, the sleeve biasing element can be a magnet and is thus magnetic, and the drawer biasing element is not a magnet but contains a metal that results in attraction of the drawer biasing element to the sleeve biasing element when brought into a proximity of each other. Alternatively, and in in another embodiment, the drawer biasing element is a magnet and the sleeve biasing element contains a metal that results in attraction of the sleeve biasing element to the magnetic drawer biasing element when brought into a proximity of each other.

In particular embodiments, the eyelash case provided in accordance with the teachings of the present disclosure include, for example, as part of the sleeve, a sleeve top wall that is transparent or translucent. In yet another aspect, the drawer is provided having an insert. In some embodiments, the insert itself is configured to include at least two eyelash mounts. In other aspects of this embodiment, the insert itself is configured to include two eyelash mounts, four eyelash mounts, six eyelash mounts, eight eyelash mounts, or ten eyelash mounts.

In still additional embodiments, the drawer includes an insert fitted an placed at a bottom of the drawer. The insert may have opposing and spaced apart first and second plateau portions. In a particular configuration, the at least two eyelash mounts are located between the plateau portions. In a particular embodiment, the eyelash mounts each have an eyelash mounting surface. The eyelash mounting surface may include a, curved surface that arises from, and is substantially perpendicular to, a bottom channel of the insert.

Particular embodiments can include a bottom channel that spans the insert and is located between the opposing and spaced apart first and second plateau portions. In one aspect, the bottom channel is juxtaposed to the drawer bottom when the insert is disposed within the internal drawer space.

In accordance with the instant disclosure, an eyelash case is disclosed that can have at least one of its first end and second ends being an open end through which the drawer passes and enters the drawer compartment. Particular embodiments can include eyelash cases having both first and second ends being open ends through which the drawer may be introduced and slide into the drawer compartment and fit therein. In such embodiments one or more biasing mechanisms as described herein may be provided at one or both ends of the eyelash case.

Additional aspects herein disclosed include an eyelash case having at least one surface that is a polychromatic surface, for example, a surface that has the appearance of, shows, or displays, a variety of or a change/changing of colors, such as is observed with mother of pearl, for example. Such surfaces can be iridescent and lustrous, showing luminous colors that seem to change when seen from different angles much like soap bubbles, butterfly wings and seashells, for example. In some embodiments, the eyelash case can have a surface, for example, a sleeve top wall that comprises iridescent or polychromatic indicia. In some embodiments, the case can a surface, for example, a top wall and/or insert, that is transparent or translucent.

In still another embodiment and in accordance with the teachings of the present disclosure, an eyelash case is disclosed comprising a sleeve having a first open end and a second closed end, the first open end and the second closed end being opposed and spaced apart from each other. The sleeve also has a sleeve top wall and a sleeve bottom wall, where the sleeve top wall and sleeve bottom wall are also opposed and spaced apart from each other, a sleeve side wall between the sleeve top wall and sleeve bottom wall and the first open end, second closed end, sleeve top wall, sleeve bottom wall and sleeve side wall bound and provide a drawer compartment. The drawer includes a drawer bottom and at least one drawer side where the drawer bottom and the at least one drawer side bound an internal drawer space and the drawer is sized to fit into the drawer compartment of the sleeve. At least one eyelash mount is located within this internal drawer space; and the eyelash case further includes a biasing mechanism having a sleeve biasing element and a drawer biasing element, the sleeve biasing element being provided at the sleeve and in proximity to the drawer compartment, whereas the drawer biasing element is provided at the drawer, the drawer biasing element being provided and arranged in substantial alignment with the sleeve biasing element, thus biasing the drawer into the drawer compartment when the sleeve biasing element and drawer biasing element are brought into proximity of each other. The drawer includes an insert having opposed and spaced apart first and second plateau portions elevated relative to a bottom channel running therebetween, and the bottom channel has at least one side wall and at least one eyelash mount adjacent to or protruding from the at least one side wall. The at least one eyelash mount has an eyelash mounting surface to which false eyelashes are mounted, this eyelash mounting surface being curved and arises from, and is substantially perpendicular to, the bottom channel. In particular embodiments, the sleeve top wall can be non-transparent or translucent or transparent and is provided in any combination with a non-transparent or translucent or transparent insert. In particular embodiments, the insert is translucent or transparent and is sized to friction fit with the internal drawer space.

In yet additional embodiments, the drawer and/or sleeve of the eyelash cases herein disclosed and in accordance with the teachings of the instant disclosure further include a grasping element located at the drawer and/or sleeve.

BRIEF DESCRIPTION OF DRAWINGS

The above and further advantages of this disclosure may be better understood by referring to the following description in conjunction with the accompanying drawings, in which like numerals indicate like structural elements and features in various figures. The drawings are not necessarily to scale, emphasis instead being placed upon illustrating the principles herein described and provided by exemplary embodiments of the invention.

DETAILED DESCRIPTION

Without wishing to be limited to any theory, the instant disclosure provides an eyelash case for storing false eyelashes and/or eyelash extensions. The eyelash case provided in accordance with the teachings of the present disclosure provides way for these delicate beauty products to be safely and securely stored and accessed, as detailed below.

Figure 1:
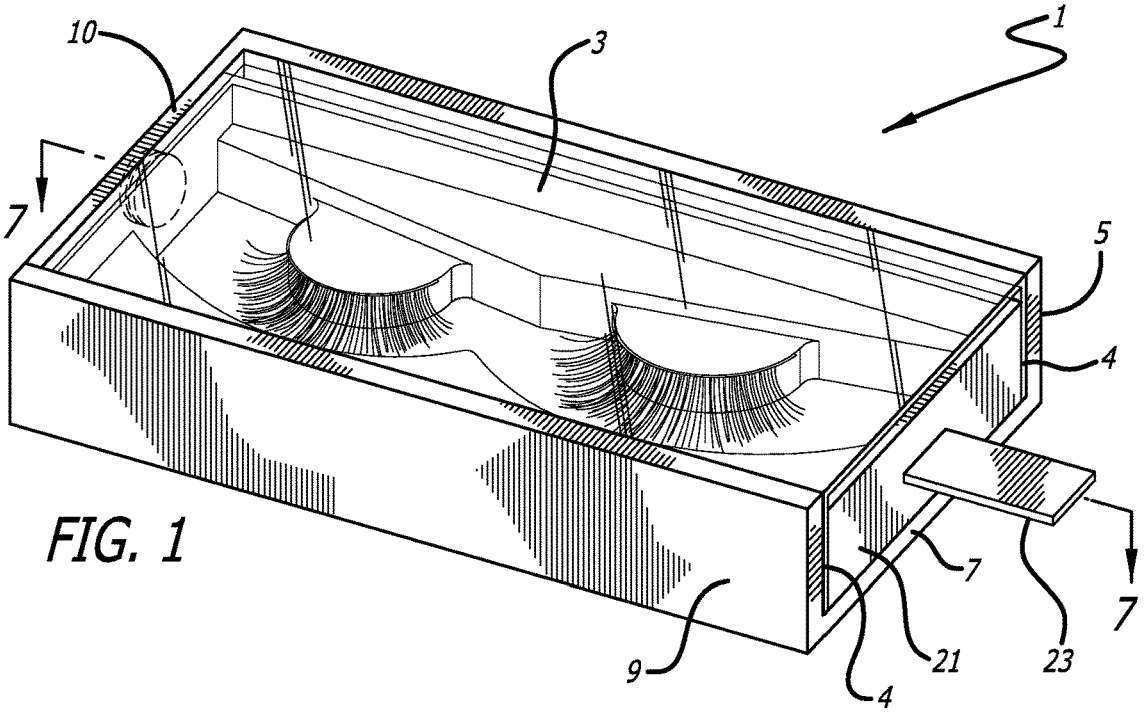
FIG. 1 is a top front perspective view of an embodiment of an eyelash case.

FIG. 1 shows an embodiment of an eyelash case 1, shown in a perspective view. The eyelash case 1 includes various portions/elements, including opposing and spaced apart ends and sides of eyelash case 1, as detailed below. In particular embodiments, at least one of the first and second ends of eyelash case 1 is an open end through which a drawer passes and enters a drawer compartment, as shown in FIG. 1.

Figure 2:
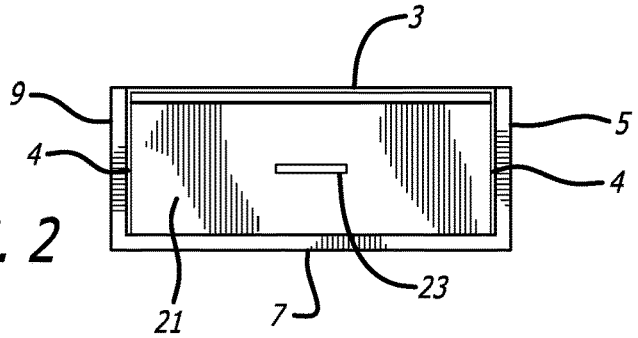
FIG. 2 is an end view of an embodiment of an eyelash case.

FIG. 2 shows a front-end plan view of eyelash case 1, having a sleeve top wall 3 and a sleeve bottom wall 7, as well as a first sleeve side wall 9 and second sleeve side wall 5, the sleeve side walls being opposed and spaced apart from on another. The sleeve top wall 3 and sleeve bottom wall 7 are substantially parallel to each other. Likewise, and first sleeve side wall 9 and second sleeve side wall 5 are also substantially parallel to one another. In this particular embodiment, sleeve top wall 3 is provided having sides that depend from sleep top wall 3 and are juxtaposed and parallel to first sleeve side wall 9 and second sleeve side wall 5, as indicated by sides 4 in FIGS. 1-2. Additionally shown in FIGS. 1-2 is grasping element 23.

Figure 3:
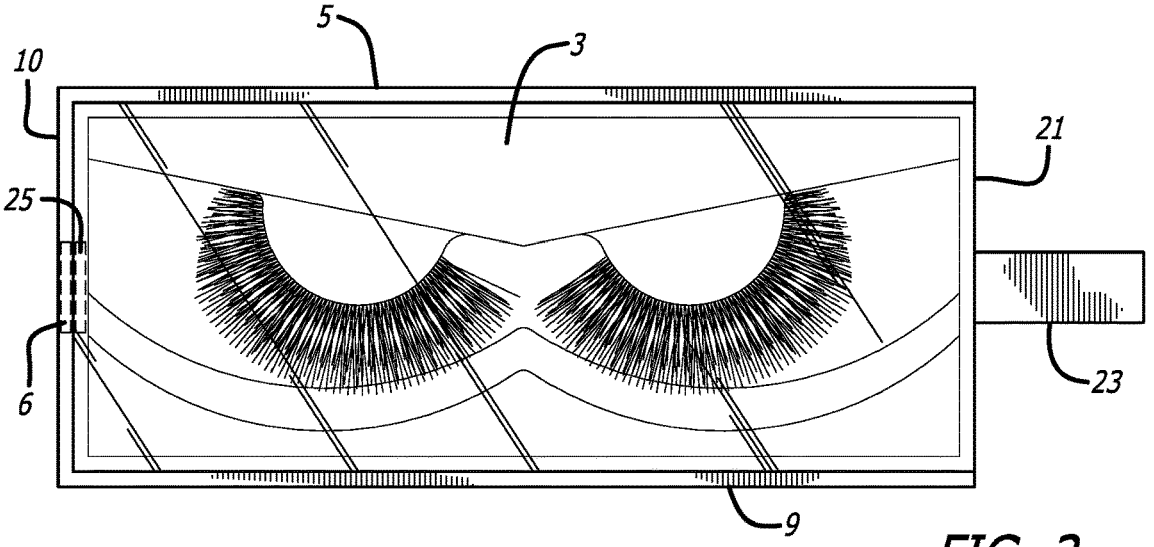
FIG. 3 is a top plan view of an embodiment of an eyelash case showing false eyelashes displayed therein.

FIG. 3 shows a top plan view of an exemplary eyelash case provided in accordance with the teachings of the present disclosure. Sleeve top wall 3 is depicted in this embodiment as being transparent or translucent so to thereby allow a user to view the false eyelashes or eyelash extensions stored therein, although in other embodiments sleeve top wall 3 is opaque so to thereby prevent or obstruct a user from viewing the false eyelashes or eyelash extensions stored therein. Sleeve top wall 3 can be clear plastic or glass or any other such transparent or translucent material that would provide a view of the interior of eyeglass case 1. In particular examples and as depicted in FIGS. 1-2, sleeve top wall 3 is provided having a thickness that is thinner than first sleeve side wall 9 and second sleeve side wall 5 or sleeve bottom wall 7. It is also noted that in particular embodiments, sides 4 are provided having approximately the same thickness as sleeve top wall 3 and similarly have a thickness that is less than the thickness of first sleeve side wall 9 and second sleeve side wall 5 or sleeve bottom wall 7. Furthermore and in one embodiment, sleeve top wall and/or sides 4 are less rigid than first sleeve side wall 9 and second sleeve side wall 5 or sleeve bottom wall 7, thus providing some deformability to an open end of eyelash case 1 through which drawer 300 passes to enter sleeve 200.

FIG. 1 and FIG. 3 show that eyeglass case 1 has a biasing mechanism, and in this embodiment, the biasing mechanism is comprised of two parts (shown in dashed lines). The biasing mechanism provides a biasing force in order to bias the eyelash case, more particularly, biasing drawer 300 into sleeve 200, in a closed and secured state. Biasing mechanism includes a sleeve biasing element 6 and a drawer biasing element 25. The sleeve biasing element 6 is provided at the sleeve and the drawer biasing element 25 is provided at the drawer. In this embodiment, the biasing elements are shown at one end of eyelash case 1 but can be provided at one or more locations of eyelash case 1. For instance, instead of or in addition to just an end portion, as shown in FIG. 3, sleeve biasing element 6 and a drawer biasing element 25 can be located along the long sides of eyelash case 1. It is contemplated that one or more biasing mechanisms can be provided in accordance with the teachings of the instant disclosure.

Figure 4:
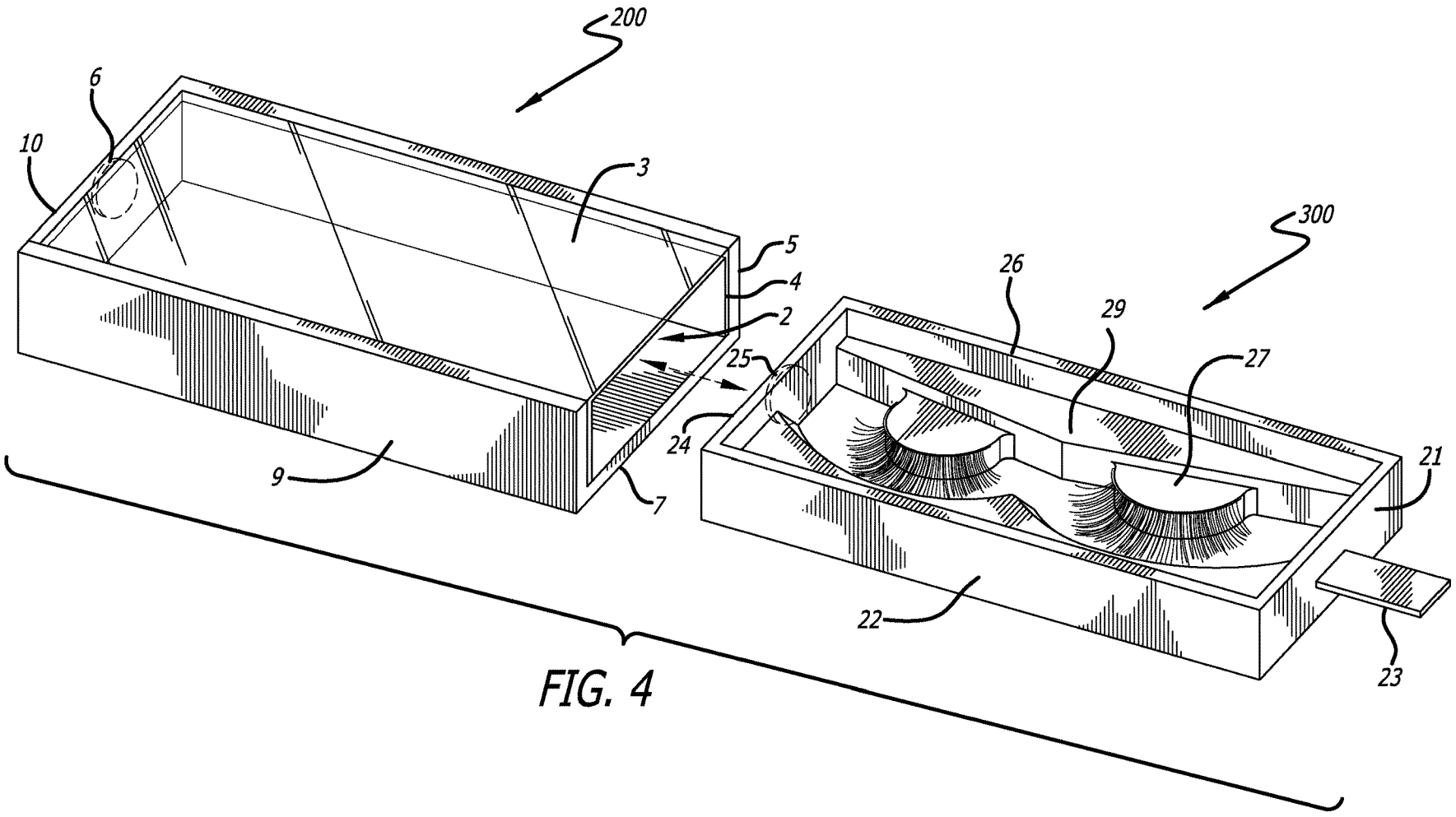
FIG. 4 is a perspective view of an embodiment of an eyelash case shown in an open position.

FIG. 4 shows a perspective view of an embodiment of an eyelash case 1 having two main components, sleeve 200 and drawer 300, and is shown in an open position with drawer 300 pulled completely out of drawer compartment 2 of sleeve 200. Drawer 300 fits and slides into drawer compartment 2. The left-hand side of FIG. 4 depicts sleeve 200 with sleeve top wall 3 (here rendered as transparent), with depending side 4 juxtaposed to sleeve side wall 5, the other opposite side of sleeve 200, namely sleeve side wall 9, likewise has side 4 juxtaposed thereon. In one embodiment sides 4 are secured to sleeve side wall 5 and sleeve side wall 9, utilizing an adhesive, for example. Sleeve 200 depicted in FIG. 4 has a back closed end 10 with sleeve biasing element 6 shown in dashed lines. The sleeve biasing element 6 portion of the biasing mechanism can be part of a magnetic biasing mechanism that utilizes magnetism to bias drawer 300 and into sleeve compartment 2 of sleeve 200. The sleeve biasing element 6 portion of the biasing mechanism is shown set within back closed end 10, but can be provided as attached to any surface of sleeve 200, as long drawer biasing element 25 is suitably provided at a location of drawer 300 such that both elements are substantially aligned with each other upon sliding of drawer 300 into sleeve 200 to thus bias the drawer 300 into sleeve 300 in accordance with the present teachings of the disclosure.

Eyelash case 1 can be made of any suitable material, such as from laminated paper, cardboard, plastic, paperboard, wood, metal or any suitable material or other combination of materials. In one embodiment, sleeve 200 can be comprised of a combination of different materials, such as paper or cardboard and plastic. In one example, sleeve top wall 3 with depending sides 4 can be made of a clear plastic material, whereas back closed end 10, first sleeve side wall 9 and second sleeve side wall 5 and sleeve bottom wall 7 can be made of a paper material, such as thick paperboard or multi-layered paperboard, for example. Furthermore, back closed end 10, first sleeve side wall 9 and second sleeve side wall 5 and sleeve bottom wall 7 can be further covered in an additional layer of material adhered thereto, such as to impart a particular color and/or indicium thereon. The surfaces, either internal or external and in any combination, of back closed end 10, first sleeve side wall 9 and second sleeve side wall 5 and sleeve bottom wall 7 can be provided having a surface with desired color and/or indicia. In a particular embodiment, at least one surface (either internal or external) of said first end, second end, sleeve bottom wall, first sleeve side wall and second sleeve side wall bounding said drawer compartment is an iridescent surface. In particular embodiments, transparent or translucent sleeve top wall 3 may also have iridescent surface indicia disposed thereon, such as company lettering, trademarks or logos, hashtags or any combination thereof.

In another example, sleeve top wall 3, first sleeve side wall 9 and second sleeve side wall 5 and sleeve bottom wall 7 are all made of a paper material, such as thick paperboard or multi-layered paperboard, for example. Furthermore, sleeve top wall 3, first sleeve side wall 9 and second sleeve side wall 5 and sleeve bottom wall 7 can be further covered in an additional layer of material adhered thereto, such as to impart a particular color and/or indicium thereon.

The right-side portion of FIG. 4 shows an exemplary drawer 300 of eyelash case 1. In this embodiment, drawer 300 has first drawer end 21 and second drawer end 24 opposed and spaced apart from each other as well as first drawer side 26 and second drawer side 22 opposed and spaced apart from each other and substantially perpendicular to said first drawer end 21 and second drawer end 24, as well as a drawer bottom 28 (shown in exploded FIG. 5). The drawer ends, drawer sides and drawer bottom bound an internal drawer space. As shown at second drawer end 24, there is provided drawer biasing element 25, shown in dashed lines. As depicted in the embodiment here, sleeve biasing element 6 and drawer biasing element 25 can be set within back closed end 10 and second drawer end 24, respectively, such that upon insertion of drawer 300 into sleeve 200, sleeve biasing element 6 and drawer biasing element 25 are brought into substantial alignment and proximity to each other and will thus bias eyelash case 1 to a closed state and thus secure drawer 300 within the drawer compartment 2. In addition, drawer 300 is shown having a plateau portion 29 and at least one eyelash mount 27 within drawer 300. Furthermore, grasping portion 23 is shown in this embodiment at first drawer end 21. It is to be noted that while grasping portion 23 is depicted here as a tab depending from first drawer end 21, it is contemplated that in alternative embodiments, grasping portion 23 may be provided at any suitable portion/location of drawer 300 that provides a user with sufficient grasping surface area to withdraw drawer 300 from sleeve 200. Furthermore, grasping portion 23 can be a solid tab, a handle, a knob, a piece of fabric, a looped piece of fabric, such fabric being smooth or rough. Roughness/coarseness of the fabric can provide a user with a better, more secure non-slip surface to grasp when withdrawing drawer 300 from sleeve 200. Indeed, sleeve biasing element 6 and drawer biasing element 25 can provide sufficient biasing force for which such roughness/coarseness can provide added advantage when pulling drawer 300 out of sleeve 200. In particular embodiments, grasping portion 23 can have a coarseness/roughness that is similar to the coarseness/roughness associated with the hook portion of hook and loop fasteners. While only one grasping portion 23 is shown in this embodiment, it is contemplated that additional grasping portions may be provided at sleeve 200, if so desired, such as at back closed end 10, for example.

Figure 5:
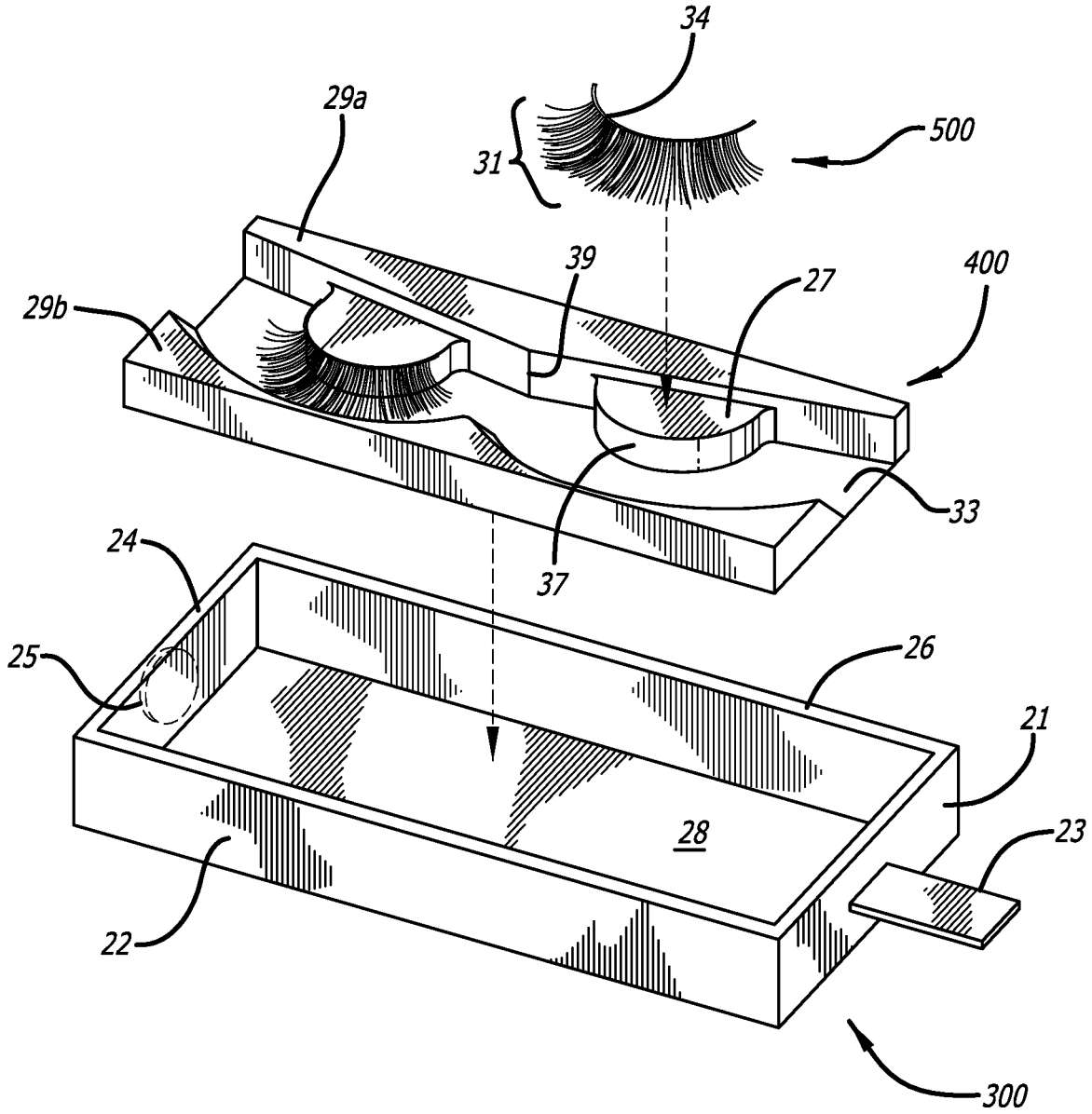
FIG. 5 an exploded view of an embodiment of a drawer having an exemplary insert and eyelash mounts.

FIG. 5 is an exploded view showing aspects of one embodiment provided in accordance with the teachings of the instant disclosure. Here, insert 400 is provided and fits within the drawer 300. Insert 400 in this embodiment is shown as being removable and is shown separated from and lifted away from drawer bottom 28. Other embodiments may provide insert 400 secured within drawer 300, if so desired. As further shown here, insert 400 provides at least one eyelash mount 27, here two eyelash mounts. Eyelash mounts may be provided in any number, depending upon the overall size of eyelash case 1, of course. For example, the insert can be configured to include two eyelash mounts, four eyelash mounts, six eyelash mounts, eight eyelash mounts, or ten eyelash mounts. In one embodiment, insert 400 has opposing and spaced apart first plateau portion 29*a* and a second plateau portion 29*b*, the at least two eyelash mounts located therebetween. First plateau portion 29*a* and a second plateau portion 29*b* are substantially parallel to drawer bottom 28 when insert 400 is positioned into/within the internal drawer space of drawer 300. Insert 400 can be made of any suitable material such as a metal, wood or plastic or any polymer, for example. Insert 400 can be comprised of plastic, and further it may be a translucent or transparent plastic that is made utilizing any known molding techniques, such as blow or injection molding. In particular embodiments, the cross-sectional thickness of the material making up insert 400 can be approximately the same thickness of the material utilized in making sleeve top wall 3, or even be made of the same material. In particular embodiments, insert 400 and sleeve top wall 3 are both provided having cross-sectional thicknesses that are less than the cross-sectional thickness of sleeve bottom wall 7, first sleeve side wall 9, second sleeve side wall 5 and back closed end 10 for example. The thickness of insert 400 and sleeve top wall 3 can be from about 0.0025 inches to about 0.0400 inches or any number therebetween.

In particular embodiments, eyelash mounts 27 can each have an eyelash mounting surface 37 to which false eyelashes 500 may be removably mounted. Removable mounting of false eyelashes 500 to eyelash mounting surface 37 is typically accomplished via a non-permanent adhesive. Eyelashes 500 are typically comprised of a plurality of false lashes 31 that are secured to and emanate from a false eyelash base 34. In particular embodiments and as shown in FIG. 5, eyelash mounting surface 37 can be curved and is substantially perpendicular to a bottom channel 33 of insert 400. In one configuration and as shown in FIG. 5, bottom channel 33 spans the longest length of insert 400 and is between and below the opposing and spaced apart plateau portion 29*a* and a second plateau portion 29*b*, the bottom channel 33 being juxtaposed (and fits flush with) drawer bottom 28 when insert 400 is placed within drawer 300. It is noted that in accordance with the present teachings, the overall geometry/configuration/contours of insert 400 can be provided as an internal part of drawer 300, that is, not as a removable insert and that drawer 300 may be made (shaped, molded, cast, or forged, for example) having an internal drawer configuration that matches the contours of insert 400.

Figure 6:
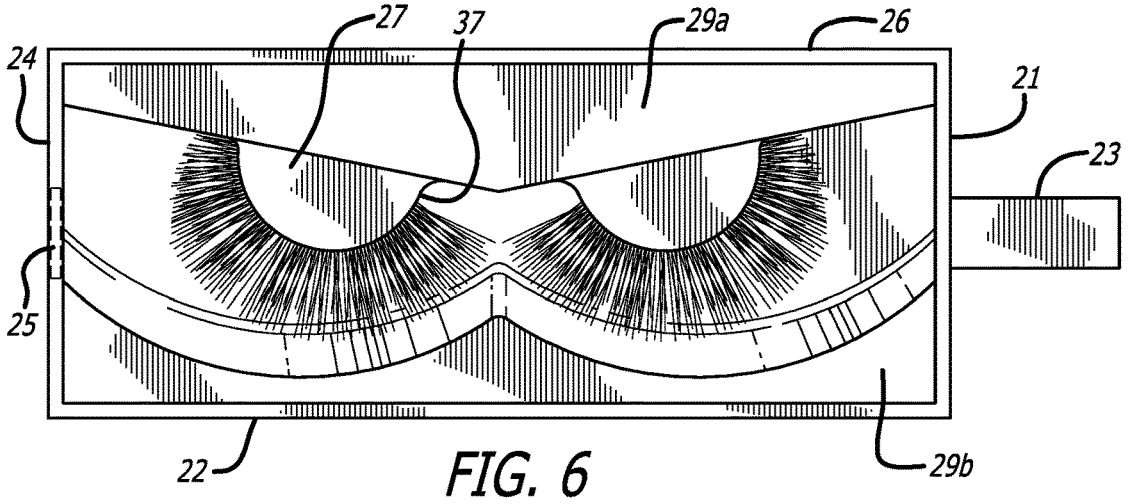
FIG. 6 is a top plan view of an embodiment of a drawer of an eyelash case.

FIG. 6 is a top plan view of drawer 300 showing insert 400 fitted within the drawer compartment, insert 300 having first plateau portion 29*a* and second plateau portion 29*b* and the top of false eyelash mount 27 (here, a pair of false eyelashes and eyelash mounts are shown) having a pair of false eyelashes disposed thereon. Grasping portion 23 is shown here at first drawer end 21 but may be at second drawer end 24 (alone or in addition to a grasping portion at first drawer end 21). Accordingly, drawer biasing element 25 (here shown at second drawer end 24) can be provided at first drawer end 21, alone or in addition to a drawer biasing element 25 at second drawer end 24. Accordingly, sleeve biasing element 6, or a plurality of sleeve biasing elements 6, would be provided at an appropriate location(s) of sleeve 200 and in accordance with the teachings herein disclosed.

Figure 7:
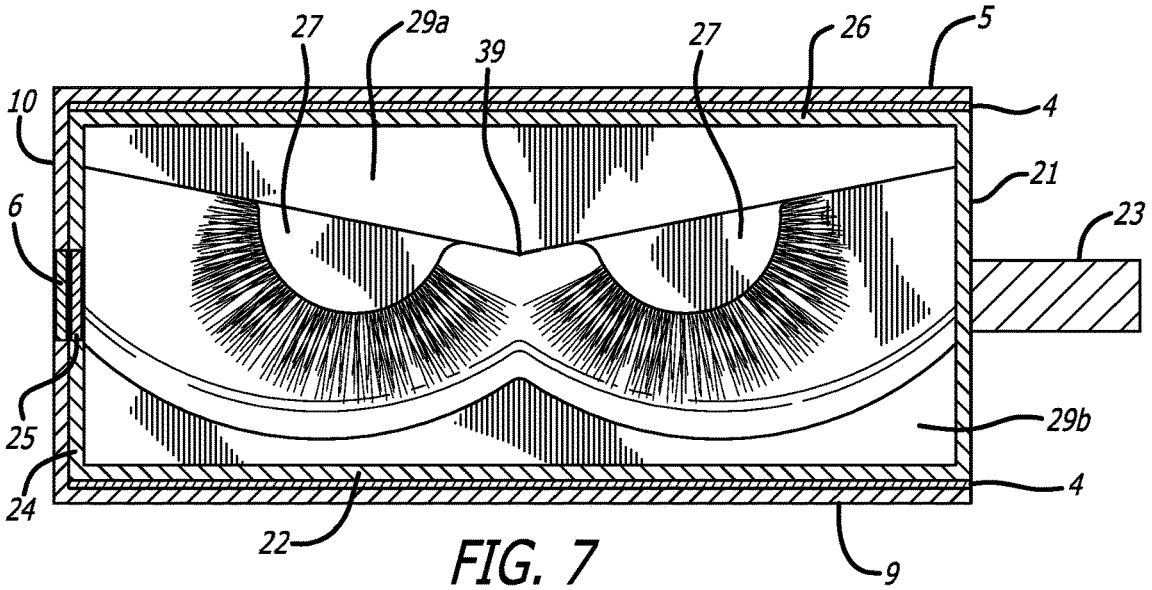
FIG. 7 is a top cross-sectional view of an embodiment of an eyelash case, taken along line 7 of FIG. 1.

FIG. 7 is a cross-sectional view taken along line 7 of FIG. 1, showing a cross-section of an embodiment of an eyelash case 1 in accordance with the instant disclosure. In this embodiment and as shown on the left side of FIG. 7, a biasing mechanism is shown that includes a sleeve biasing element 6 and a drawer biasing element 25. Here, the sleeve biasing element 6 provided set within back closed end 10 of sleeve 200 and is in proximity to the drawer compartment. While depicted at this particular location, sleeve biasing element 6 can be provided at any useful position of sleeve 200. Sleeve biasing element 6 may, in addition to being set within the wall of back closed end 10 of sleeve 200, be positioned on either an internal or external surface of back closed end 10 of sleeve 200, for example or any surface of sleeve 200 so long as it aligns with a drawer biasing element 25 of drawer 300 in order to affect a bias of drawer into the sleeve in accordance with the teachings provided by the instant disclosure. Similarly, drawer biasing element 25 is here depicted embedded within the wall of second drawer end 24, however drawer biasing element 25 may also be provided at any useful position of drawer 300, for example. Drawer biasing element 25 may, in addition to being set within the wall of second drawer end 24 of drawer 300, be positioned on either an internal or external surface of second drawer end 24 of drawer 300, for example, the main consideration being that the locations of the biasing elements are sufficiently aligned and in proximity to each other such that the elements of the biasing mechanism, in this example, sleeve biasing element 6 and drawer biasing element 25, result in a biasing force 30 that biases the drawer into the drawer compartment when the biasing elements are brought into sufficient proximity of each other. This is graphically illustrated in an exemplary embodiment shown in FIG. 8. Sufficient proximity, as utilized herein, means that distance between a sleeve biasing element 6 and a drawer biasing element 25 at which the biasing force is sufficiently strong enough to be first detected by a user, typically via gasping grasping portion 23. Such distances obviously vary according to the configuration, type, number and method by with a biasing mechanism is provided in accordance with the teachings of the instant disclosure to bias drawer 300 into sleeve 200, to secure it therein.

Figure 8:
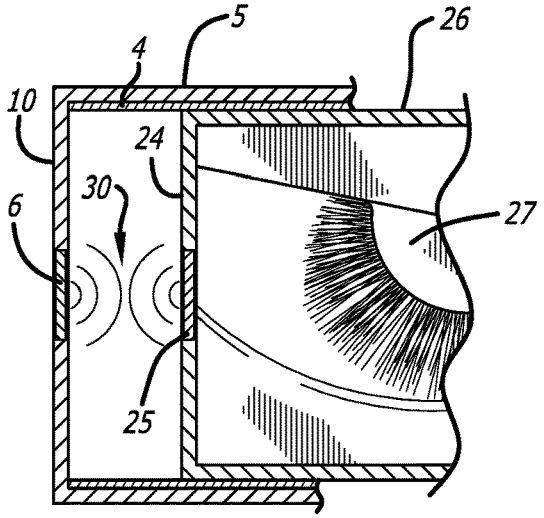
FIG. 8 is a top plan cross-sectional view of an embodiment of an eyelash case showing an exemplary drawer and sleeve in a non-closed position, illustrating a biasing force provided by one example of a biasing mechanism according to the present disclosure, its elements being brought into proximity of one another.

FIG. 8 shows an embodiment of a portion of a cross-section of the eyelash case 1 in a partially closed position, that is, drawer 300 is not wholly within sleeve 200. In one exemplary embodiment, sleeve biasing element 6 and drawer biasing element 25 configured such that when they are brought into proximity of each other a biasing force 30 results between these two biasing elements, drawing each towards one another and resultantly biasing drawer 300 into sleeve 200 to secure drawer 300 therein. In one embodiment, biasing force 30 is a magnetic force, when either one or both of sleeve biasing element 6 and drawer biasing element 25 are magnets. If both are magnets, then they are obviously provided having their respective magnetic poles aligned such that they attract and not repel one another (obviously the two magnets are attracted by their opposite poles and are so accordingly configured in the eyelash case of the instant disclosure). Non-limiting examples of proximities where biasing elements are brought into sufficient proximity of each other where a biasing force is initially established include up to 25 millimeters, up to 24 millimeters, up to 23 millimeters, up to 22 millimeters, up to 21 millimeters, up to 20 millimeters, up to 19 millimeters, up to 18 millimeters, up to 17 millimeters, up to 16 millimeters, up to 15 millimeters, up to 14 millimeters, up to 13 millimeters, up to 12 millimeters, up to 11 millimeters, up to 10 millimeters, up to 9 millimeters, up to 8 millimeters, up to 7 millimeters, up to 6 millimeters, up to 5 millimeters, up to 4 millimeters, up to 3 millimeters, up to 2 millimeters and up to 1 millimeter. While exemplary a magnetic biasing mechanism has been shown, other biasing mechanisms/may be utilized, such as hook and loop fasteners and adhesives having sufficient tackiness, for example, pressure sensitive adhesives, to secure drawer 300 into sleeve 200. Elements of such systems may be provided at locations similar to sleeve biasing element 6 and drawer biasing element 25 as shown herein, other locations and/or numbers biasing elements are contemplated.

Figure 9:
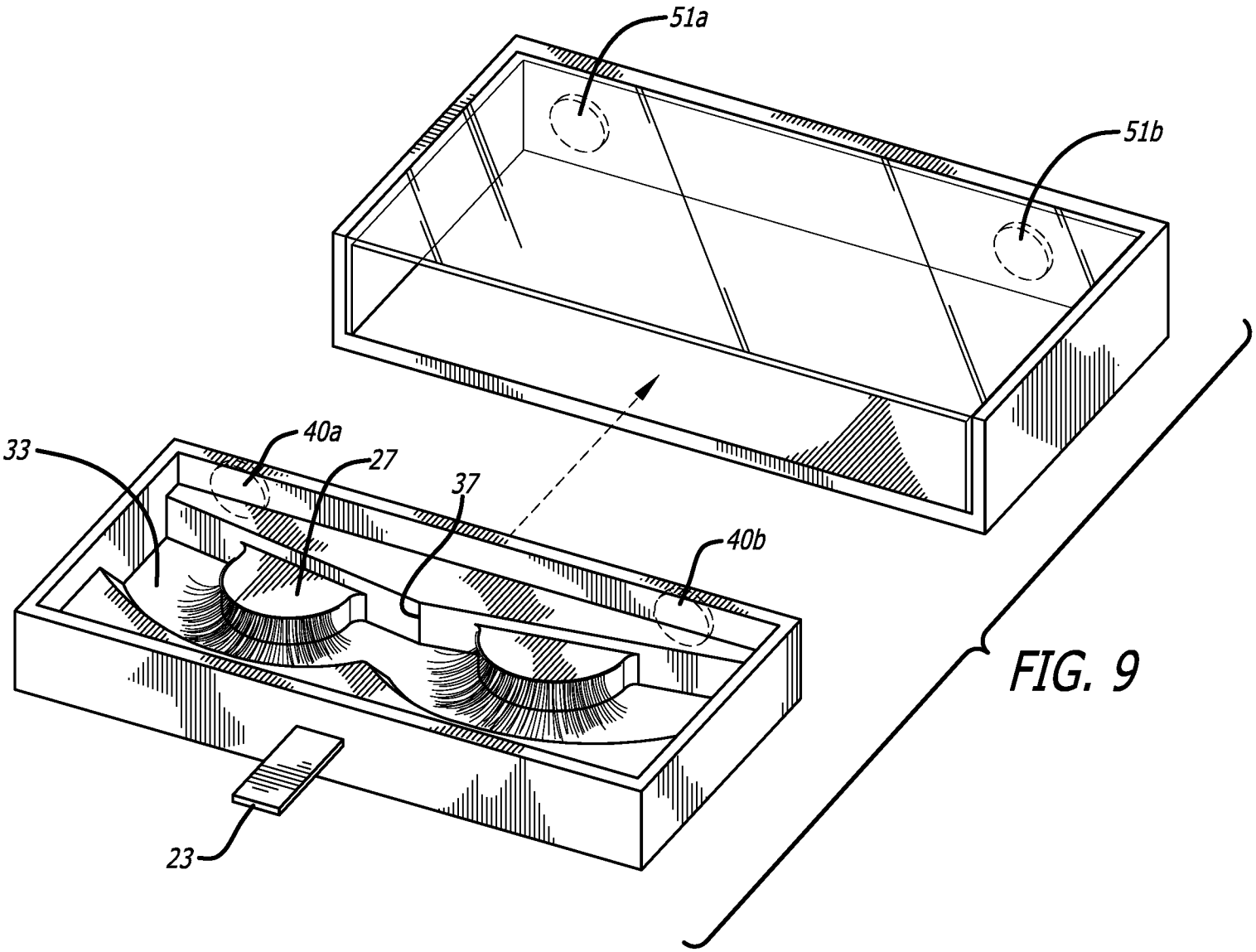
FIG. 9 shows another embodiment of an eyelash case illustrating the principals of the instant disclosure, shown in an open position.

Turning to FIG. 9, an embodiment is shown from a perspective view, the drawer of the eyelash case having a plurality of drawer biasing elements 40*a* and 40*b* spaced apart and at a long, back side of the drawer. Accordingly, sleeve biasing elements 51*a* and 51*b* are appropriately disposed in this embodiment such that when drawer biasing elements 40*a* and 40*b* are in substantial alignment with sleeve biasing elements 51*a* and 51*b*, the drawer is biased into the drawer compartment when these pluralities of sleeve biasing elements and drawer biasing elements are brought into a proximity of each other. Exemplary proximities can be up to and including about 30 millimeters, up to about 25 millimeters, up to about 20 millimeters, up to about 15 millimeters, up to about 10 millimeters, up to about 5 millimeters and up to about 1 millimeter.

While eyelash case 1 has been generally shown to have a rectangular shape, it is contemplated that eyelash case can be any preferred shape, including, but not limited to, a disc shape, a cylindrical a triangular shape, a pyramidal shape, a spherical shape, a square shape, a cubic shape or a trapezoidal shape. In addition, an exemplary shape of sleeve biasing element 6 and drawer biasing element 25 are shown having a circular shape. It is further contemplated that sleeve biasing element 6 and drawer biasing element 25 can be shaped, including and not limited to, a square, rectangular, ellipse, or triangular shape. In addition, sleeve biasing element 6 and drawer biasing element 25 are shown here in one embodiment as being centered in their respective sides of sleeve 200 and drawer 300. It is contemplated that when a plurality of sleeve biasing elements and drawer biasing elements are utilized, they may be evenly spaced apart or adjacent each other at their respective positions at sleeve 200 and drawer 300. In addition, while only one drawer 300 is shown in the figures, it is contemplated that eyeglass case 1 can have a plurality of drawers 300, as well as a plurality of pairs of false eyelashes on a plurality of pairs of eyelash mounts.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular, article, apparatus, methodology, or materials or methods described herein, unless expressly stated as such. In addition, those of ordinary skill in the art will recognize that certain changes, modifications, permutations, alterations, additions, subtractions and sub-combinations thereof can be made in accordance with the teachings herein disclosed without departing from the spirit of the present specification. It is therefore intended that the following appended claims and claims hereafter introduced are interpreted to include all such changes, modifications, permutations, alterations, additions, subtractions and sub-combinations as are within their true spirit and scope.

Certain embodiments of the present invention are described herein. Of course, variations on these described embodiments will become apparent to those of ordinary skill in the art upon reading the foregoing disclosures and teachings. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (and equivalent open-ended transitional phrases thereof like including, containing and having) encompasses all the expressly recited elements, limitations, steps and/or features alone or in combination with unrecited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amended for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present disclosure. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents is based on the information available to the applicant and does not constitute any admission as to the correctness of the dates or contents of these documents.

Lastly, the terminology used herein is for the purpose of describing particular embodiments only and is not intended to limit the scope of the present invention, which is defined solely by the claims. Accordingly, the present invention is not limited to that precisely as shown and described.

The invention claimed is:

1. An eyelash case, comprising:

a sleeve defining a drawer compartment, the sleeve comprising a first open end and a second closed end, the first open end and the second closed end opposing and spaced apart from one another, a sleeve top wall and a sleeve bottom wall, the sleeve top wall and the sleeve bottom wall opposed and spaced apart from one another, and a first sleeve side wall and a second sleeve side wall, the first sleeve side wall and the second sleeve side wall opposed and spaced apart from one another, the first open end, the second closed end, the sleeve top wall, the sleeve bottom wall and the sleeve side wall bounding the drawer compartment;

a drawer defining an internal drawer space, the drawer comprising a first drawer end and a second drawer end, the first drawer end and the second drawer end opposed and spaced apart from each other, a first drawer side and a second drawer side, the first and second drawer sides opposed and spaced apart from each other and substantially perpendicular to said first and second drawer ends, and a drawer bottom, the first and second drawer ends, the first and second drawer sides and the drawer bottom bounding the internal drawer space, wherein the drawer is sized to fit into the drawer compartment;

an insert comprising at least two eyelash mounts, the insert sized to fit into the internal drawer space; and a magnetic biasing mechanism comprising a sleeve biasing element and a drawer biasing element, the drawer biasing element positioned at the second drawer end of the drawer and the sleeve biasing element positioned at the second closed end of the sleeve, the drawer biasing element being in substantial alignment with the sleeve biasing element in a manner that biases the drawer into the drawer compartment when the sleeve biasing element and the drawer biasing element are brought into proximity of each other.

2. The eyelash case of claim 1, wherein the sleeve biasing element or the drawer biasing element comprises a magnet.

3. The eyelash case of claim 1, wherein the sleeve biasing element and the drawer biasing element each comprise a magnet.

4. The eyelash case of claim 1, wherein the sleeve biasing element comprises a magnet and the drawer biasing element is not a magnet but includes a metal that renders attraction of the drawer biasing element to the sleeve biasing element when brought into a proximity of each other.

5. The eyelash case of claim 1, wherein the drawer biasing element comprises a magnet and the sleeve biasing element includes a metal that renders attraction of the sleeve biasing element to the drawer biasing element when brought into a proximity of each other.

6. The eyelash case of claim 1, wherein the sleeve biasing element is provided at the second closed end of the sleeve.

7. The eyelash case of claim 1, wherein the drawer biasing element is provided at the second drawer end of the drawer.

8. The eyelash case of claim 1, wherein the sleeve biasing element is provided at the second closed end of the sleeve and the drawer biasing element is provided at the second drawer end of the drawer.

9. The eyelash case of claim 1, wherein the magnetic biasing mechanism comprising a plurality of sleeve biasing elements and a plurality of drawer biasing elements.

10. The eyelash case of claim 1, wherein the at least two eyelash mounts are two eyelash mounts, four eyelash mounts, six eyelash mounts, eight eyelash mounts, or ten eyelash mounts.

11. The eyelash case of claim 1, wherein the insert is translucent or transparent.

12. The eyelash case of claim 1, wherein the insert is sized to friction fit with the internal drawer space.

13. The eyelash case of claim 1, wherein the insert comprises a first plateau portion, a second plateau portion and a bottom channel, the first and second plateau portions being opposed and spaced apart and elevated relative to the bottom channel running therebetween.

14. The eyelash case of claim 13, wherein the at least two eyelash mounts are located between the first and second plateau portions.

15. The eyelash case of claim 13, wherein the bottom channel comprises a side wall, the side wall including the at least two eyelash mounts emanating from the side wall.

16. The eyelash case of claim 1, wherein the at least two eyelash mounts each have an eyelash mounting surface, the eyelash mounting surface being curved and arising from and substantially perpendicular to a bottom channel of the insert.

17. The eyelash case of claim 1, wherein the sleeve top wall is transparent or translucent.

18. The eyelash case of claim 1, wherein at least one exterior surface of the second closed end, the sleeve bottom wall, the first sleeve side wall and the second sleeve side wall is an iridescent surface.

19. The eyelash case of claim 17, wherein the sleeve top wall and the sleeve bottom wall include iridescent indicia therein or thereon.

20. The eyelash case of claim 1, wherein the drawer includes a grasping element located at the first drawer end.

* * * * *